US006443593B1

(12) United States Patent
Lauschner

(10) Patent No.: US 6,443,593 B1
(45) Date of Patent: Sep. 3, 2002

(54) LUMINAIRE FOR LUMINOUS ADVERTISEMENT

(75) Inventor: Christoph Lauschner, Hilpoltstein (DE)

(73) Assignee: Maas & Roos Lichtwerbung GmbH, Hilooltstain (DE)

( * ) Notice: Subject to any disclaimer, the term of this patent is extended or adjusted under 35 U.S.C. 154(b) by 0 days.

(21) Appl. No.: 09/642,155

(22) Filed: Aug. 21, 2000

(30) Foreign Application Priority Data

Aug. 20, 1999 (DE) ..... 299 14 456

(51) Int. Cl.[7] ..... F21V 21/00

(52) U.S. Cl. ..... 362/239; 362/249; 362/812; 362/800; 40/564

(58) Field of Search ..... 362/249, 252, 362/812, 800, 235; 40/564, 570, 546, 572

(56) References Cited

U.S. PATENT DOCUMENTS 4,924,362 A * 5/1990 Janko et al. ..... 362/108
5,249,104 A * 9/1993 Mizobe ..... 362/31
5,577,831 A * 11/1996 Chang ..... 362/240
5,950,340 A * 9/1999 Woo ..... 40/564

FOREIGN PATENT DOCUMENTS

| | | |
|---|---|---|
| DE | 2045215 | 3/1972 |
| DE | 3636347 A1 | 4/1988 |
| DE | 9307862.5 | 7/1993 |
| DE | 9415477.5 | 11/1994 |
| DE | 4415457 A1 | 11/1995 |

* cited by examiner

*Primary Examiner*—Thomas M. Sember
(74) *Attorney, Agent, or Firm*—Browdy & Neimark, P.L.L.C.

(57) ABSTRACT

A luminaire for luminous advertisement. The luminaire is composed of: a massive core plate that reflects the desired contour shape of the luminaire, with the core plate made of a translucent material; a multitude of light diodes that are individually inserted into corresponding receptacle bores in the rear of the core plate, with the light diodes connected to a voltage supply; and a cover plate that tightly covers the rear with the light diodes.

11 Claims, 3 Drawing Sheets

LUMINAIRE FOR LUMINOUS ADVERTISEMENT

BACKGROUND OF THE INVENTION

1. Field of the Invention

The present invention relates to a luminaire for luminous advertisement.

2. Background Art

Luminous advertisements on building facades, such as store names or the like, generally consist of individual luminaires, each of which has the shape of an individual letter of the name. Each individual luminaire letter must be manufactured with its individual shape adapted to the given appearance and size of the lettering in the luminous advertisement. In the known luminaires, the housing that receives the light source, which is formed of an appropriately curved fluorescent tube, is manufactured individually from aluminum sheets or sheet steel in such a way that a bottom corresponding to the shape and size of the letter is cut out of sheet material and provided with an edge that is made of an appropriately folded, strip-shaped flat material and forms the sidewalls of the housing. The open face opposite the bottom is closed with a translucent cover—the so-called "reflector"—which, again, takes the outline or contour of the letter.

To simplify the production of his type of luminaire, it was suggested, for example in DE 94 15 477 U1, to form the housing in one piece by milling its outer contour and milling out the interior of the housing from a massive block of millable synthetic material. This eliminates minimum air gaps, as they are required for high voltage connections of fluorescent tubes relative to metallic housing components, thus resulting in a reduced overall depth of the luminaire.

As light diodes with ever increasing luminosities are being developed, these are now increasingly used as light sources for luminous advertisement, as it is revealed, for example, in DE 93 07 862 U1. Light diodes have significant advantages in his context, since they can be operated at low voltage, for example, and are significantly less susceptible to failure and damage than fluorescent tubes. Furthermore, their power consumption is up to 90% less than that of so-called "neon advertisements".

For the known luminaires with light diodes, the box-shaped housings that were described at the beginning are still used, on the bottom of which a multitude of light diodes are arranged on interlinked modules. The use of these huge quantities compensates for the low luminosity of the individual light diodes. However, the outer appearance of luminaires of this type is virtually indistinguishable from the customary neon advertisements since the side elements of the housings still consist of nontransparent, easily punchable and bendable metal material. If a housing is to be produced that also has an illuminated edge, this edge must be assembled of translucent material in a complex procedure, which is particularly difficult in the case of curved edges.

SUMMARY OF THE INVENTION

The invention is based on the object of creating a luminaire for luminous advertisement that presents the appearance of a fully luminous body. This object is met with the characteristics which consist in a massive core plate that reflects the desired contour shape of the luminaire, with the core plate made of an opaque material; a multitude of light diodes that are individually inserted into corresponding receptacle bores in the rear of the core plate, with the light diodes connected to a voltage supply; and a cover plate that tightly covers the rear with the light diodes. The corresponding luminaire incorporates a massive core plate that reflects the desired contour shape of the luminaire and is made of an opaque, i.e., translucent but not transparent material. A multitude of light diodes are individually inserted into corresponding receptacle bores provided on the rear of the core plate and connected to an appropriate power supply. A cover plate is furthermore provided, which tightly covers the rear with the light diodes.

Based on the above-explained design of an inventive luminaire, this luminaire is very sturdy and optimally suited for use on building facades. For the placement and fastening of the light diodes, a simple design provides for a seat in the respective receptacle bores. From an illumination point of view, this placement is relevant within the meaning of the object of the present invention in that the light that is emitted by the light diodes transmits through the wall of the receptacle bores directly into the body of the core plate, where it is scattered by the opaque material, and the core plate thus shines in its full volume, "from inside", so to speak. The core plate thus also shines through all exterior surfaces in such a manner that an even illumination characteristic is attained by the use of the opaque material. Lastly, with the cover closure, the luminaire is protected against all kinds of weather.

Additional characteristics, details and advantages of the invention furthermore become apparent from the following description, in which an example embodiment of the inventive object is explained in detail based on the appended drawings.

DESCRIPTION OF THE PREFERRED EMBODIMENT

Figure 1:
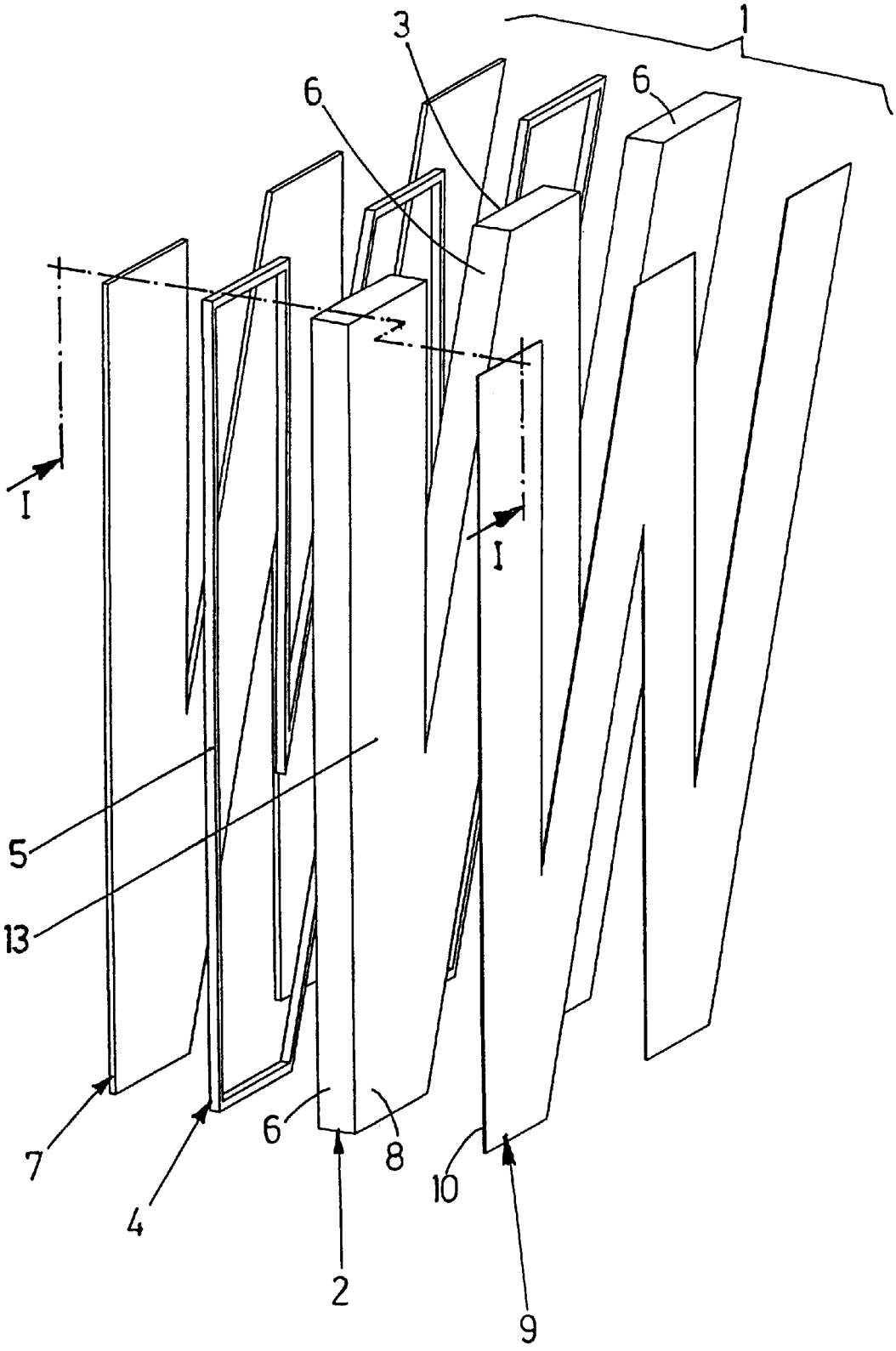
FIG. 1 is a perspective exploded view of a luminaire in its basic design.
Figure 2:
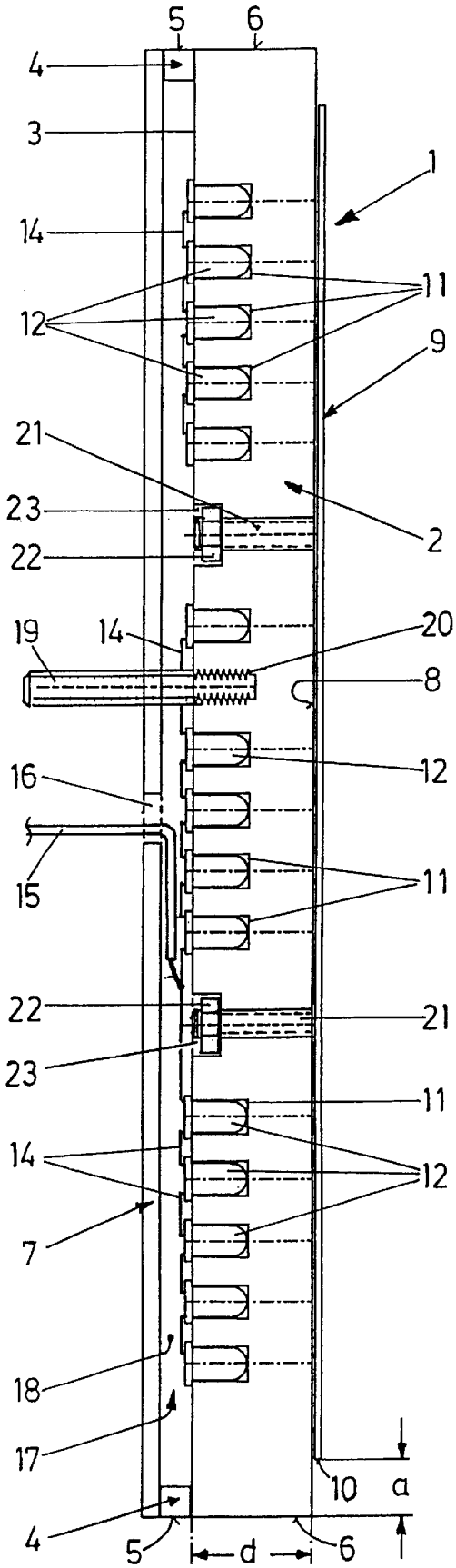
FIG. 2 is a sectional view of a leg of the luminaire, shown in the sectional plane marked in a dot-and dash pattern in FIG. 1, in a first embodiment.

As apparent from FIGS. 1 and 2, the luminaire, which is marked in its entirety with 1, comprises, for example in the shape of the letter "W", a massive core plate 2 that reflects the desired contour shape of the luminaire 1, in this case showing the letter "W" in a top view. This core plate is made of an opaque material, such as milky-white acrylic synthetic glass. The thickness of the core plate is approximately 20 mm. Placed onto the rear 3 of the core plate is a frame element 4 of rectangular acrylic strip material, the exterior outline of which corresponds to the contour of the core plate 2. The exterior sides 5 of the frame element 4 are thus flush with the edge surfaces 6 of the core plate 2. Towards the rear, the luminaire 1 is closed and tightly covered with a cover plate 7 also of acrylic synthetic glass, which corresponds in its contour to the core plate 2.

On the front 8 of the core plate 2 a reflector plate 9 of polished stainless steel is provided, the outer contour of which extends offset towards the inside relative to the contour of the core plate 2. In FIG. 2 this is apparent from the distance a of the outer edge 10 of the reflector plate 9 from the edge surface 6. The reflector plate reflects the light that impinges on it from behind, and thus increases the luminosity of the luminaire 1.

The design of the luminaire 1 with respect to its illumination can be explained based on FIG. 2. Accordingly, a multitude of receptacle bores 11, the diameter and depth of which is matched to the outer dimensions of the light diodes 12, are drilled into the rear 3 of the core plate 2. These light diodes 12 are white light diodes, for example, of an optically diffuse material. They are arranged parallel to the contour edge—i.e., to the respective edge surface 6 of the core plate 2—in rows. If the individual legs 13 of the luminaire 1 exceed certain width dimensions, additional light diodes may also be distributed two-dimensionally across the contour area on the rear 3 of the core plate 2. The arrangement and spacing of the light diodes 12 essentially needs to be adapted to the given concrete requirements. The main criterion is to render the illumination of the core plate as even as possible to avoid the impression of singular light sources inside the luminaire.

The light diodes 12 that are inserted into the respective receptacle bores 11 are wired together via their correction bases 14 and connected to a voltage supply, which is not shown, for 24 V low-voltage. A connecting cable 15 is inserted for this purpose through a corresponding cable hole 16 into the wiring space 17 between the cover plate 7 and the core plate 2. After completion of the entire wiring and connection to the connecting cable 15, the space 17 may be hermetically sealed against all external influences with an opaque pourable sealing compound 18 through a pouring hole, which is not shown. This also protects the wiring and fixes the light diodes 12 in their inserted positions in the receptacle bores 11. The light diodes 12 may additionally also be glued into the receptacle bore 11.

To fasten the luminaire 1 to a support plate or directly to a building facade, set screws 19 are provided, which are screwed from behind through the cover plate 7 and through the wiring space 17 into corresponding thread bores 20 in the core plate 2. The reflector plate 9 is attached by means of threaded bolts 21 that are fixed to the rear of the reflector plate 9 and secured on the rear 3 of the core plate 2 by nuts 22 in corresponding recesses 23.

Figure 3:
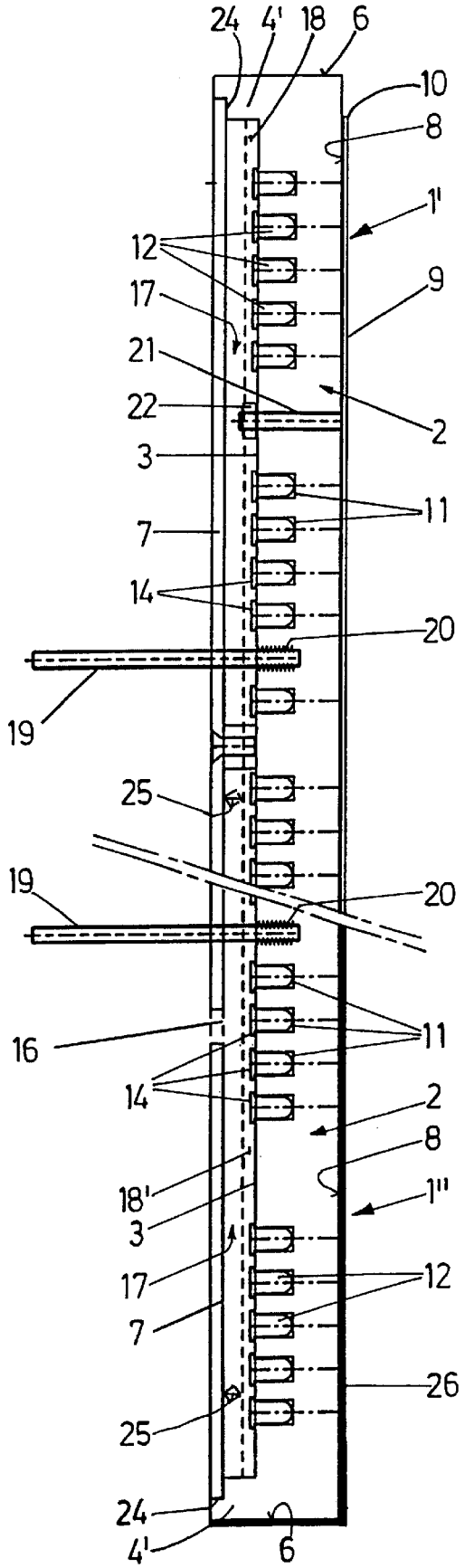
FIG. 3 is a sectional view, analogous to FIG. 2, divided in two halves showing two further embodiments of the luminaire.

Two further embodiments of the luminaire are shown in FIG. 3 as partial sections. In the upper half of FIG. 3, a luminaire 1' is shown which, regarding the design of the core plate 2, the placement of the light diodes 12 in receptacle bores 11, the cover plate 7, and the reflector plate 9, does not differ from the embodiment shown in FIG. 2. To this extent, reference can thus be made to the description there.

What is different in this example embodiment is the design of the frame element 4', which is formed in one piece with the core plate 2. A stepped receptacle groove 24 is provided in this design, which extends along the inside of the frame element 4', and into which the cover plate 7 is inserted.

A further difference from the embodiment shown in FIG. 2 is that the wiring space 17 between the cover plate 7 and the core plate 2 is not completely compound-filled. Instead, the pourable sealing compound 18' is poured in only to a level above the core plate 2 at which the live components, such as the connection bases 14 of the light diodes 12, are hermetically compound-sealed. An air space 25 thus remains between the pourable sealing compound 18' and the interior of the cover plate 7.

In the lower half of FIG. 3, a further embodiment of the luminaire is shown, marked with 1", which differs from the embodiment in the upper half of FIG. 3 in that the reflector plate 9 was left off. Instead, the front 8 of the core plate 2 and its edge surface 6 are covered light-tight by a coat of lacquer 26. Since the pourable sealing compound 18' and the cover plate 1, in contrast, are designed translucent and thus light transmitting, the luminaire 1" illuminates the area behind it. The letter itself appears completely black on the front towards the observer and is surrounded, in a typical "corona effect", by an illuminated background.

What is claimed is:

1. A luminaire for luminous advertisement, said luminaire having a selected contour shape and comprising:

a massive core plate having a shape that corresponds to the selected contour shape, said core plate having a rear and a front and being made of a translucent material;

a multitude of light emitting diodes that are individually inserted into corresponding receptacle bores in the rear of the core plate, with the light emitting diodes connected to a voltage supply;

a cover plate that tightly covers the rear and covers the light emitting diodes; and a reflector plate fixed on the front of the core plate, the reflector plate having an outer contour that extends offset towards the inside relative to the shape of the core plate.

2. A luminaire according to claim 1, wherein the core plate has a contour edge and said light emitting diodes are arranged in a row parallel to the contour edge of the core plate.

3. A luminaire according to claim 1, wherein the light emitting diodes are essentially evenly distributed across the rear of the core plate.

4. A luminaire according to claim 1, further comprising a frame element having an exterior outline that corresponds to the selected contour shape, said frame element being arranged between the core plate and the cover plate to form a wiring space for the light emitting diodes.

5. A luminaire according to claim 4, wherein the frame element is formed in one piece on the core plate.

6. A luminaire according to claim 1, wherein the light emitting diodes are made of an optically diffuse material.

7. A luminaire according to claim 1, wherein the core plate is made of a milky acrylic synthetic glass.

8. The luminaire according to claim 1 wherein the selected contour shape is a shape that provides advertising information.

9. The luminaire according to claim 8 wherein the selected contour shape is an alphanumeric character.

10. A luminaire for luminous advertisement, said luminaire having a selected contour shape and comprising:

a massive core plate having a shape that corresponds to the selected contour shape, said core plate having a rear and a front, being provided with a plurality of receptacle bores in said rear, and being made of a translucent material;

a plurality of light emitting diodes each individually inserted into a respective one of said receptacle bores and each light emitting diode having a live component connected to a voltage supply;

a cover plate that tightly covers said rear and covers said light emitting diodes;

a frame element having an exterior outline that corresponds to the selected contour shape, said frame element being arranged between said core plate and said cover plate to form a wiring space for said light emitting diodes, wherein the wiring space is hermetically compound-sealed after completion of wiring of said light emitting diode in the area of the live components; and a reflector plate fixed on the front of the core plate, the reflector plate having an outer contour that extends offset towards the inside relative to the shape of the core plate.

11. A luminaire for luminous advertisement, said luminaire having a selected contour shape and comprising:

a massive core plate having a shape that corresponds to the selected contour shape, said core plate having a rear, a front and an edge surface, being provided with a plurality of receptacle bores in said rear, and being made of a translucent material;

a plurality of light emitting diodes each individually inserted into a respective one of said receptacle bores and each light emitting diode having a live component connected to a voltage supply;

a cover plate that tightly covers said rear and covers said light emitting diodes, wherein said front and edge surface of said core plate are covered light-tight and said cover plate is light transmitting; and a reflector plate fixed on the front of the core plate, the reflector plate having an outer contour that extends offset towards the inside relative to the shape of the core plate.

* * * * *